US007754058B2

(12) United States Patent
Asaumi

(10) Patent No.: US 7,754,058 B2
(45) Date of Patent: Jul. 13, 2010

(54) ION EXCHANGE MEMBRANE ELECTROLYZER

(75) Inventor: Kiyohito Asaumi, Tamano (JP)

(73) Assignee: Chlorine Engineers Corp., Ltd., Tokyo (JP)

( * ) Notice: Subject to any disclaimer, the term of this patent is extended or adjusted under 35 U.S.C. 154(b) by 429 days.

(21) Appl. No.: 11/806,724

(22) Filed: Jun. 4, 2007

(65) Prior Publication Data

US 2007/0278095 A1 Dec. 6, 2007

(30) Foreign Application Priority Data

Jun. 5, 2006 (JP) ..... 2006-155919

(51) Int. Cl.
*C25B 9/04* (2006.01)

(52) U.S. Cl. ..... 204/252; 204/253; 204/286.1; 204/288; 204/288.2; 204/288.3

(58) Field of Classification Search ..... 204/252, 204/286.1, 288.3, 242, 253, 288.4, 297.07, 204/297.08, 297.09, 297.1, 297.14, 254–258, 204/283–289, 288.2
See application file for complete search history.

(56) References Cited

U.S. PATENT DOCUMENTS

| | | | | |
|---|---|---|---|---|
| 4,096,054 | A | 6/1978 | Specht et al. | |
| 7,045,041 | B2 * | 5/2006 | Katayama | 204/252 |
| 2003/0188966 | A1 * | 10/2003 | Katayama | 204/297.14 |
| 2007/0235338 | A1 * | 10/2007 | Kodama et al. | 204/627 |

FOREIGN PATENT DOCUMENTS

| | | | |
|---|---|---|---|
| EP | 0568071 | A1 | 11/1993 |
| EP | 1 378 589 | A1 | 1/2004 |
| FR | 2 576 325 | A1 | 7/1986 |
| JP | 1988-099486 | U1 | 6/1988 |
| JP | 1990-027779 | U1 | 2/1990 |
| JP | 2000-144467 | A | 5/2000 |
| JP | 2004-002993 | A | 1/2004 |
| JP | 2006-024531 | A | 1/2006 |

OTHER PUBLICATIONS

European Search Report dated Nov. 27, 2008, issued in corresponding European Patent Application No. 07109604.4.
European Search Report dated Sep. 29, 2008 issued in corresponding European Patent Application No. 07105863.0.

* cited by examiner

*Primary Examiner*—Bruce F Bell
(74) *Attorney, Agent, or Firm*—Westerman, Hattori, Daniels & Adrian, LLP

(57) ABSTRACT

An ion exchange membrane electrolyzer comprises electrodes at least either of which is held in contact with leaf springs formed integrally with a leaf spring holding member arranged in an electrode chamber so as to extend toward the electrode and remain electrically energized at the respective electrode touching sections thereof, each of the leaf springs having a crooked section arranged at a position separated from its connecting section connecting itself to the leaf spring holding member and adapted to be bent toward the leaf spring holding member when the electrode touching section is pressed toward the leaf spring holding member side.

8 Claims, 11 Drawing Sheets

ION EXCHANGE MEMBRANE ELECTROLYZER

CROSS-REFERENCE TO RELATED APPLICATIONS

This application is based upon and claims the benefit of priority from prior Japanese Patent Application No. 2006-155919, filed Jun. 5, 2006, the entire contents of which are incorporated herein by reference.

BACKGROUND OF THE INVENTION

1. Technical Field

This invention relates to an ion exchange membrane electrolyzer. More particularly, the present invention relates to an ion exchange membrane electrolyzer that can hold the gap between the electrodes of the electrolyzer to a predetermined dimension.

2. Description of the Related Art

The voltage required for electrolysis in an electrolyzer for electrolysis of aqueous solution depends on various factors. Above all, the gap between the anode and the cathode of the electrolyzer affects significantly to the electrolyzer voltage. It is a common practice to reduce the energy consumption necessary for electrolysis by reducing the gap between the electrodes and hence the eloectrolyzer voltage.

In ion exchange membrane electrolyzers that operate for electrolysis of brine, the electrolyzer voltage is reduced by arranging the trio of the anode, the ion exchange membrane and the cathode in a condition where they are held in tight contact with each other. However, in a large electrolyzer where the electrodes extend over an area of several square meters and the anode and the cathode are rigid members, it is difficult to hold them in tight contact with the ion exchange membrane and keep the inter-electrode gap to a predetermined small distance.

Thus, there have been proposed electrolyzers where a flexible member is used for either the anode or the cathode to make the inter-electrode gap adjustable.

Various electrolyzers using a flexible member as means for reducing the inter-electrode gap have been proposed. More specifically, electrodes formed by arranging a flexible member made of woven fabric, unwoven fabric or a network of fine metal threads on a porous electrode substrate are known.

Since the flexible members of such electrodes are formed by using fine metal threads, they can give rise to problems such as that the electrode is partially deformed to make the inter-electrode gap uneven when it is pressed excessively by the counter-pressure from the other electrode and that some of the fine metal threads stick in the ion exchange membrane.

Japanese Patent No. 3501453 proposes an electrolyzer in which the electrode chamber bulkhead side and the electrode are electrically conductively connected by means of a large number of plate-shaped leaf springs.

FIG. 11A of the accompanying drawings is a schematic perspective view of known leaf springs that can be used in an electrolyzer. FIG. 11B of the accompanying drawings is a schematic cross sectional horizontal view of the electrode chamber of an electrolyzer comprising leaf springs as shown in FIG. 11A.

A plurality of pairs of obliquely standing leaf springs 12, each having a profile of a tooth of a comb, are fitted to a plate-shaped leaf spring holding member 11. A total of three pairs of teeth-like leaf springs are shown in FIG. 11B. The teeth-like leaf springs 12 of each pair extend in opposite directions to show an inter-digital arrangement as a whole.

Each leaf spring 12 has an electrode-touching section 15 formed by bending the front end which touches the electrode toward the leaf spring holding member 11 so as to extend substantially in parallel with the leaf spring holding member 11. An electrically conductive connection is established as the electrode-touching section 15 touches an electrode.

As shown in FIG. 11B, electrode touching sections 15 that extend substantially in parallel with the leaf spring holding member 12 are arranged at the cathode side of a cathode chamber 9 so that the leaf springs 12 touch the cathode 8 as the gap between the cathode 8 and the leaf spring holding member 11 is reduced.

However, if the cathode 8 is pressed to a large extent in the assembling process or the pressure rises abnormally to invert the pressure relationship between the anode chamber 6 and the cathode chamber 9 in favor of the anode side while the electrolyzer is in a preparation stage for operation and the gap between the cathode 8 and the cathode chamber bulkheard 7 is reduced, some of the leaf springs 12 can be plastically deformed to lose their resiliency once the gap is reduced beyond a certain limit. Particularly, the cathode chamber is normally made of plates of nickel that is a poorly resilient metal material so that, once its resiliency is lost, its function of adjusting the inter-polar distance by its resiliency is also lost to give rise to a problem that the predetermined inter-polar distance is no longer maintained.

The present invention relates to an electrolyzer in which electrodes and a collector are bound to each other by a flexible conducting member and the object of the present invention is to provide an electrolyzer that comprises electrodes having a large area and the surfaces of the electrodes can be held smooth so that neither of the electrodes may not be moved in any direction and no excessive pressure is applied to the surfaces of the ion exchange membrane by the flexible conducting member and that the flexible conductive member retains its resiliency if the pressure relationship between the anode chamber and the cathode chamber is inverted by abnormally high pressure in the electrolyzer.

SUMMARY OF THE INVENTION

In an aspect of the present invention, there is provided an ion exchange membrane electrolyzer comprising electrodes at least either of which is held in contact with leaf springs formed integrally with a leaf spring holding member arranged in an electrode chamber so as to extend toward the electrode and remain electrically energized at the respective electrode touching sections thereof, each of the leaf springs having a crooked section arranged at a position separated from its connecting section connecting itself to the leaf spring holding member and adapted to be bent toward the leaf spring holding member when the electrode touching section is pressed toward the leaf spring holding member side.

Preferably, in an ion exchange membrane electrolyzer as defined above, each of the leaf springs has a touching section bent toward the leaf spring holding member at the front end thereof so that the touching section of the leaf spring and the electrode are held in contact over a flat surface or a curved surface of the touching section.

Preferably, in an ion exchange membrane electrolyzer as defined above, the width of each of the leaf springs is gradually diminished toward the front end and may or may not be increased once again at the touching section.

Preferably, in an ion exchange membrane electrolyzer as defined above, the leaf spring holding member has an opening at the projection surface of each of the leaf springs and the projection surfaces of adjacent leaf springs are connected by the leaf spring holding member.

Preferably, in an ion exchange membrane electrolyzer as defined above, each of the leaf spring has a recessed section formed between the connecting section and the crooked section to move away from the electrode that is held in contact with the leaf spring so as to extend in parallel with the connecting section.

Preferably, in an ion exchange membrane electrolyzer as defined above, each of the leaf springs has a down-falling section formed at a position separated from the connecting section connecting itself to the leaf spring holding member so as to fall down and move away from the electrode that is held in contact with the leaf spring and an up-rising section formed at a position closer to the front end so as to rise up again toward the electrode.

Preferably, in an ion exchange membrane electrolyzer as defined above, the leaf spring holding member is connected to the electrode chamber bulkhead of a bipolar type electrolyzer to establish a fixed conductive connection.

Preferably, in an ion exchange membrane electrolyzer as defined above, the leaf spring holding member forms a cylindrical internal falling flow channel of electrolyte of a window-frame-shaped mono-polar type electrolyzer and is connected to a current distribution means for distributing an electric current to establish a fixed conductive connection.

Preferably, an ion exchange membrane electrolyzer as defined above further comprises a connection assisting member that is a plate-shaped member or a comb-shaped member having a teeth section extending in the area where the leaf springs are projected to the side opposite to the electrode held in contact with the leaf springs arranged between and connected to the leaf spring holding member and the electrode chamber bulkhead surface or the current distribution means.

In an ion exchange membrane electrolyzer according to the present invention, each leaf spring held in contact with an electrode at the electrode touching section thereof to establish a conductive connection is provided with a crooked section arranged at a position separated from its connecting section and adapted to be bent and deformed when the electrode surface is pressed. Thus, when the leaf spring is pressed, the stress of deformation is not concentrated at the connecting section of the leaf spring and hence the leaf spring does not lose the characteristics of a spring if the leaf spring is pressed under abnormally high pressure and deformed.

BRIEF DESCRIPTION OF THE DRAWINGS

The invention will be described with reference to the accompanying drawings, wherein like members reference like elements.

DESCRIPTION OF EXEMPLARY EMBODIMENTS

An electrolyzer according to the present invention comprises a plate that is provided with leaf springs and arranged at the electrode chamber bulkhead and the collector. Each of the leaf springs has a crooked section arranged at a position separated from its connecting section connecting itself to the leaf spring holding member and adapted to be bent when pressed so that the stress applied to the connecting section of the leaf spring and the leaf spring holding member can be reduced if the leaf spring is pressed and hence the stress acting on said connecting section is minimized. Then, as a result, it is possible to prevent any of the leaf springs from being deformed to come no longer able to restore its original form if the pressure relationship in the electrode chamber is inverted.

Now, the present invention will be described in greater detail by referring to the accompanying drawings.

While the present invention is described below in terms of an electrolyzer in which a leaf spring holding member is connected to the cathode chamber bulkhead and the cathode is made movable so that the gap between the cathode and the anode can be adjusted, such a leaf spring holding member may alternatively be connected to the anode chamber bulkhead and the anode is made movable so that the gap between the electrodes can be adjusted.

Figure 1A:
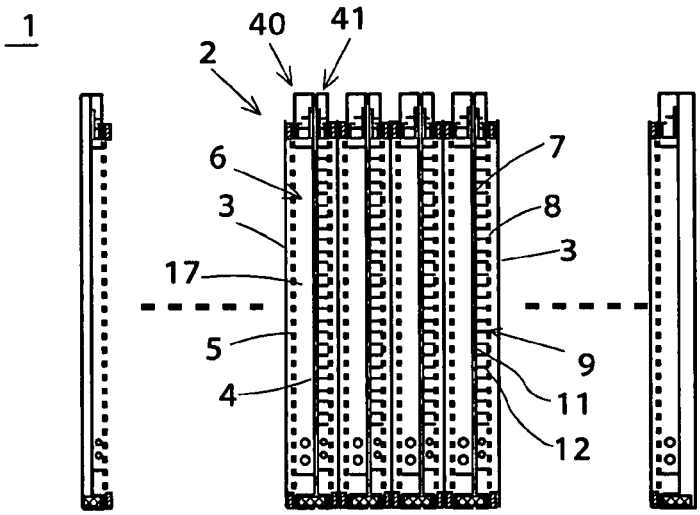
FIG. 1A is an exploded schematic cross sectional view of an embodiment of ion exchange membrane electrolyzer according to the present invention and comprising a plurality of electrolyzer units laid one on the other.
Figure 1B:
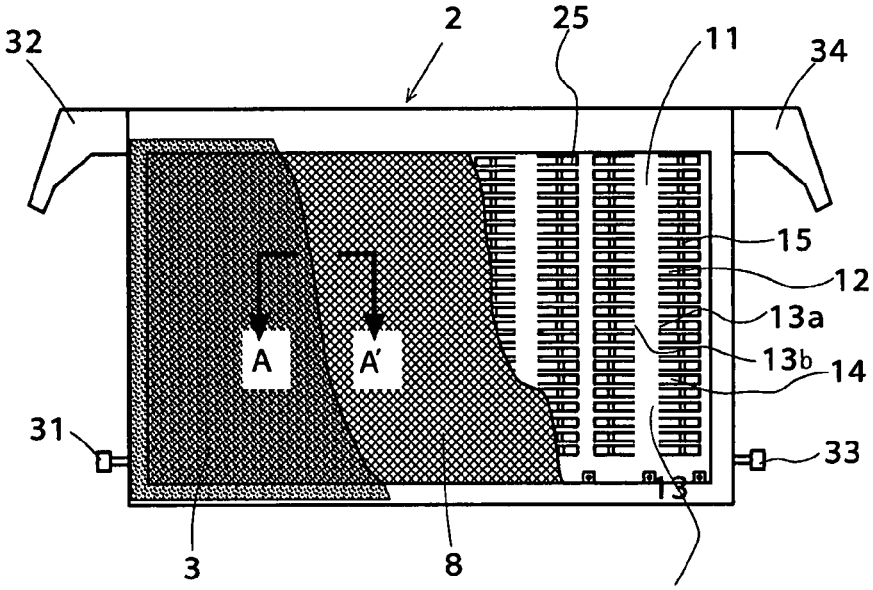
FIG. 1B is a schematic plan view of an electrolyzer unit of the embodiment of FIG. 1A as viewed from the cathode side.
Figure 1C:
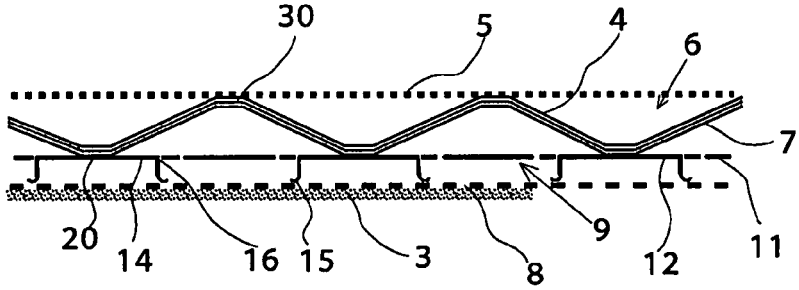
FIG. 1C is a schematic cross sectional view of the electrolyzer unit of FIG. 1B taken along line A-A' in FIG. 1B.

FIG. 1A is an exploded schematic cross sectional view of an embodiment of ion exchange membrane electrolyzer according to the present invention and comprising a plurality of electrolyzer units laid one on the other. FIG. 1B is a schematic plan view of an electrolyzer unit of the embodiment of FIG. 1A as viewed from the cathode side. FIG. 1C is a schematic cross sectional view of the electrolyzer unit of FIG. 1B taken along line A-A' in FIG. 1B.

As shown in FIG. 1A, the ion exchange membrane electrolyzer 1 is formed by laying a predetermined number of bipolar type electrolyzer units 2 one on the other with an ion exchange membrane 3 interposed between two adjacent units.

An anode 5 is arranged in each of the electrolyzer unit 2 at a position separated from an anode chamber bulkhead 4 to form an anode chamber 6. A cathode 8 is also arranged in each of the electrolyzer unit 2 at a position separated from a cathode chamber bulkhead 7 and a cathode chamber 9 is formed between the cathode chamber bulkhead 7 and the corresponding ion exchange membrane 3.

An anode chamber side gas/liquid separation means 40 and a cathode chamber side gas/liquid separation means 41 are arranged respectively in an upper part of the anode chamber 6 and in an upper part of the cathode chamber 9.

Additionally, the anode chamber 6 of the electrolyzer unit 2 is provided with an anolyte supply port 31, whereas the anode chamber side gas/liquid separation means 40 is provided with an anolyte discharge port 32 for discharging anolyte and gas when the concentration thereof is reduced.

Similarly, the cathode chamber 9 of the electrolyzer unit 2 is provided with a catholyte supply port 33, whereas the cathode chamber side gas/liquid separation means 41 is provided with a catholyte discharge port 34 for discharging catholyte and gas when the concentration thereof is reduced.

Gas/liquid mixture fluid containing gas generated at the anode is subjected to gas/liquid separation in an upper part of the anode chamber and a part of the electrolyte flows out from the anolyte detecting port 32, while another part of the electrolyte falls in the anode chamber and mixed with the anolyte supplied from the anolyte supply port 31 arranged at the electrolyzer and subjected to electrolysis at the anode.

While the anolyte supply port and the anolyte discharge port are arranged at the same side in FIG. 1B, the supply port and the discharge port may be arranged respectively at the opposite sides and the anolyte supply port and the catholyte supply port may be arranged at the same side.

As shown in FIGS. 1B and 1C, a leaf spring holding member 11 is fitted to the cathode chamber bulkhead linking sections 20 of the cathode chamber bulkhead 7 and leaf springs 12 are connected to the leaf spring holding member 11.

The connecting sections 13 of the low pass filter holding member 11 and the leaf springs 12 are arranged at regular intervals and axially symmetrically relative to straight lines extending in the vertical direction of the electrolyzer. A pair of leaf springs 12 connected to respective connecting sections 13*a*, 13*b*, which are also paired, extend in opposite directions. The leaf springs 12 respectively have respective crooked sections 14 arranged at positions separated from its connecting sections 13*a*, 13*b* and electrode touching sections 15 are formed at the front ends of the crooked sections 14 so as to contact the electrode and establish an electrically conductive connection.

Each crooked section 14 is a part of a leaf spring 12 at which the leaf spring 12 is bent when the electrode touching section 15 is subjected to force directed toward the surface of the leaf spring holding member. In the case of the leaf springs illustrated in FIGS. 1A through 1C, each leaf spring extends horizontally from the connecting section connecting itself to the leaf spring holding member and the front end where the electrode touching section is formed extends vertically from the up-rising section 16.

Since the crooked section 14 is formed at a part separated from the connecting section connecting the leaf spring 12 to the leaf spring holding member, any concentration of stress at the connecting section 13 is avoided if the leaf spring 12 is pressed repeatedly toward the leaf spring holding member 11 or subjected to abnormally high pressure applied to it at the start of an operation of the electrolyzer, although such high pressure scarcely takes place. Thus, it is possible to avoid the connecting section from being unrecoverably plastically deformed due to concentration of stress at the connecting section 13.

When a recessed section 17 is formed between the connecting section 13 and the crooked section 14 in parallel with the connecting section 13 and move away from the electrode surface, the leaf spring 12 can show an enhanced effect of avoiding plastic deformation due to concentration of stress at the connecting section 13.

The electrode touching section 15 formed at the front end of the leaf spring 12 is bent to show an obtuse angle or a curve to touch the electrode. Thus an electric current flows as the electrode touching section 15 touches the cathode 8.

The leaf springs 12 are arranged at regular intervals and axially symmetrically relative to straight lines extending in the vertical direction of the electrolyzer and the electrode touching section 15 arranged at the front end of each leaf spring 12 contacts the cathode 8. Therefore, the cathode 8 that is touched by the electrode touching section 15 is not subjected to any force trying to move it in a direction parallel to the cathode surface but subjected only to force rectangular to the cathode surface.

Since the leaf springs 12 only displace the cathode 8 in a direction rectangular relative to the cathode surface and does not move the cathode 8 in parallel with the cathode surface by their repulsive force, there does not arise any problem of damaging the ion exchange membrane and hence it is possible to properly adjust its position.

The leaf spring holding member 11 that is mounted to the cathode chamber bulkhead may be realized by a single member having a size substantially equal to that of the cathode surface or by a predetermined number of members.

The leaf spring holding member 11 has openings 25 produced when it is cut and bent to prepare leaf springs 12. Therefore, the bubble-containing catholyte that comes up along the electrode surface and falls through the space at the side of the cathode chamber bulkhead 7 by way of the openings 25 after releasing gas at the top thereof before it is electrolyzed in the electrolyzer with the catholyte supplied by way of the catholyte supply port 33 and discharged from the catholyte discharge port 34.

On the other hand, the anode chamber bulkhead 4 and the anode 5 are connected to each other at the anode chamber bulkhead connecting section 30. They are connected to each other by way of a continuous welded section or a large number of spot-like welded sections to that they are mechanically held together and an electro-conductive connection is established there.

In an ion exchange membrane electrolyzer according to the present invention, both the anode chamber bulkhead and the cathode chamber bulkhead shows an undulated profile such as a truss-type profile that can raise the rigidity of the electrode chambers prepared by means of thin plates of titanium, nickel or the like.

Figure 2A:
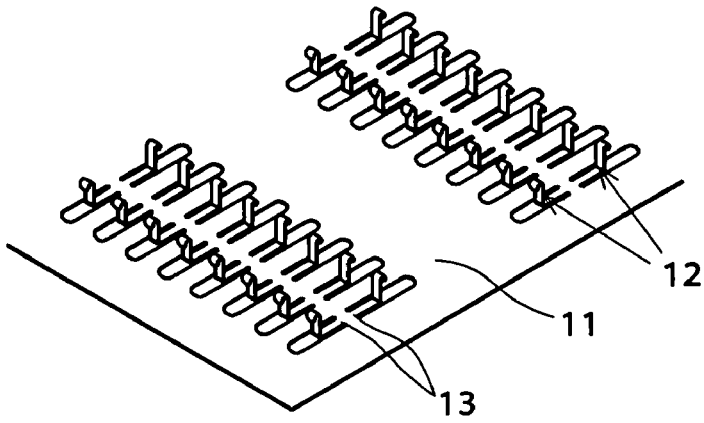
FIG. 2A is a schematic perspective view of an embodiment of leaf springs according to the present invention.
Figure 2B:
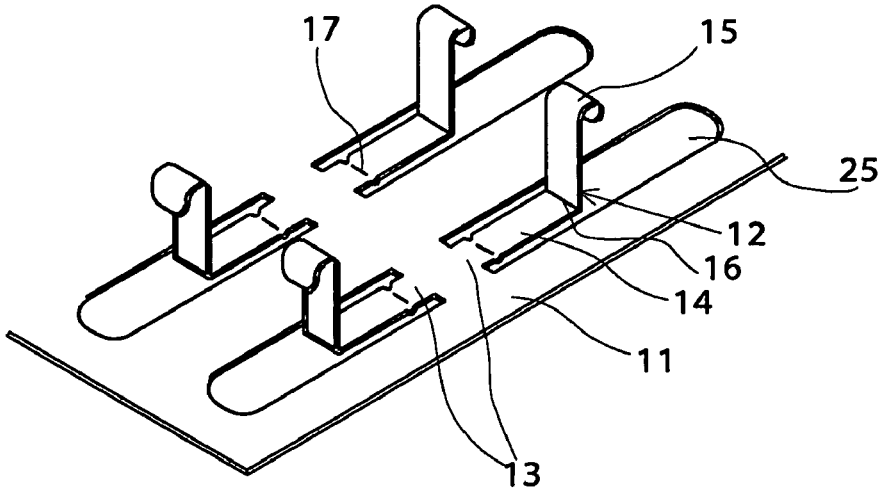
FIG. 2B is an enlarged schematic perspective view of leaf springs.
Figure 2C:
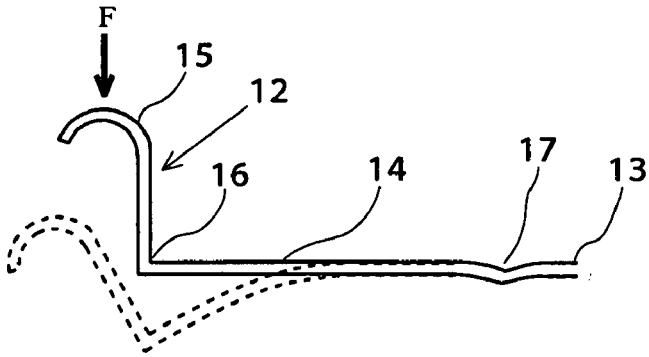
FIG. 2C is a schematic lateral view of one of the leaf springs, illustrating the operation of each of the leaf springs of FIG. 2A.

FIG. 2A is a schematic perspective view of an embodiment of leaf springs according to the present invention. FIG. 2B is an enlarged schematic perspective view of leaf springs. FIG. 2C is a schematic lateral view of one of the leaf springs, illustrating the operation of each of the leaf springs of FIG. 2A.

The leaf spring holding member 11 and the leaf springs 12 are prepared integrally by partly cutting a plate member except the connecting sections 13 thereof and executing a predetermined bending process on them in such a way that each leaf spring 12 is connected to the leaf spring holding member 11 by way of a connecting section 13. Each leaf spring 12 extends in the plane of the leaf spring holding member and then rises up at the up-rising section 16 vertically toward the electrode to be electrically connected to the surface of the leaf spring holding member 11. Each leaf spring 12 has an electrode touching section 15 at the front end thereof.

As the electrode touching section 15 of each leaf spring 12 is subjected to force F, the leaf spring 12 is deformed at the crooked section 14 that is separated from the connecting section 13 and the up-rising section 16 as indicated by broken lines in FIG. 2C so that its front end section is deformed to move toward the opening 25 produced when the leaf spring 12 is prepared. Then, as a result, it is possible to avoid concentration of stress at the connecting section that can arise when a leaf spring is made to rise and extend obliquely immediately from a connecting section.

It is possible to further reduce the stress applied to the connecting section 13 by forming a recessed section 7 in parallel with the connecting section 13 between the connecting section 13 and the crooked section 14 of the leaf spring 12. The recessed section 17 can be formed by way of a bending process in the course of preparing the leaf spring.

Each leaf spring 12 can be prepared by cutting or punching a plate member along predetermined cutting lines, producing an up-rising section by means of a bending process and then bending the front end part to make it show a curved profile.

Figure 3A:
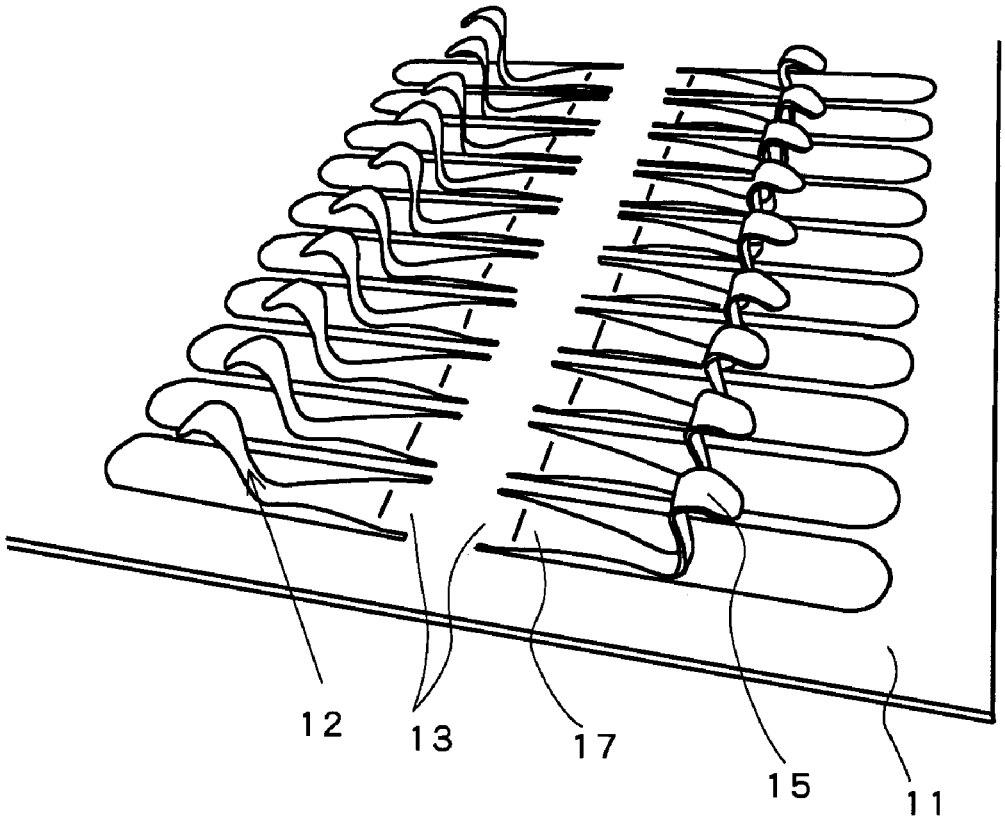
FIG. 3A is a schematic perspective view of another embodiment of leaf springs according to the present invention.
Figure 3B:
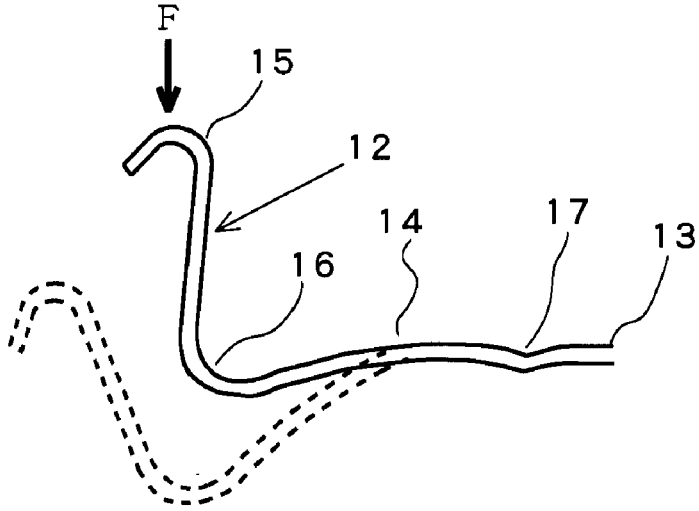
FIG. 3B is a schematic lateral view of one of the leaf springs, illustrating the operation of each of the leaf springs of FIG. 3A.

FIG. 3A is a schematic perspective view of another embodiment of leaf springs according to the present invention. FIG. 3B is a schematic lateral view of one of the leaf springs, illustrating the operation of each of the leaf springs of FIG. 3A.

Each leaf spring 12 is prepared by partly cutting a plate member except the connecting section 13 of the leaf spring holding member 11 and the leaf spring 12. It falls from the connecting section to move away from the electrode side and draw a curve from a position located on the plane of the leaf spring holding member and then it rises up at an up-rising section 16 also to draw a curve. The leaf spring 12 has an electrode touching section 15 at the front end thereof.

As the electrode touching section 15 of each leaf spring 12 is subjected to force F, the leaf spring 12 is deformed at the crooked section 14 that is separated from the connecting section 13 as indicated by broken lines in FIG. 3B. Then, as a result, it is possible to avoid concentration of stress at the connecting section that can arise when a leaf spring is made to rise and extend obliquely immediately from a connecting section.

The width of each leaf spring 12 is gradually diminished from the connecting section 13 to the electrode touching section 15. In other words, the electrode touching section 15 has a large width. Then, as a result, the touching area of the electrode touching section 15 on the electrode is increased to prevent any adverse effect of concentration of stress at the part of the electrode touching the electrode touching section on the ion exchange membrane from arising.

It is possible to further reduce the stress applied to the connecting section 13 by forming a recessed section 17 in parallel with the connecting section 13 between the connecting section 13 and the crooked section 14 of the leaf spring 12.

The recessed section 17 can be formed by way of a bending process in the course of preparing the leaf spring.

Figure 4A:
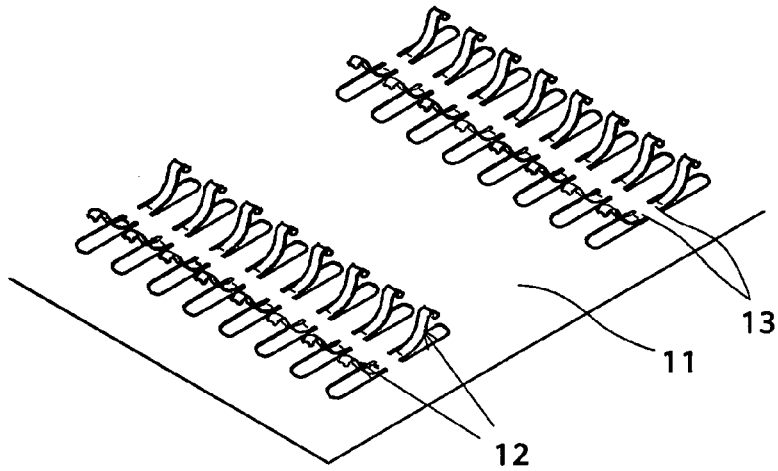
FIG. 4A is a schematic perspective view of still another embodiment of leaf springs according to the present invention.
Figure 4B:
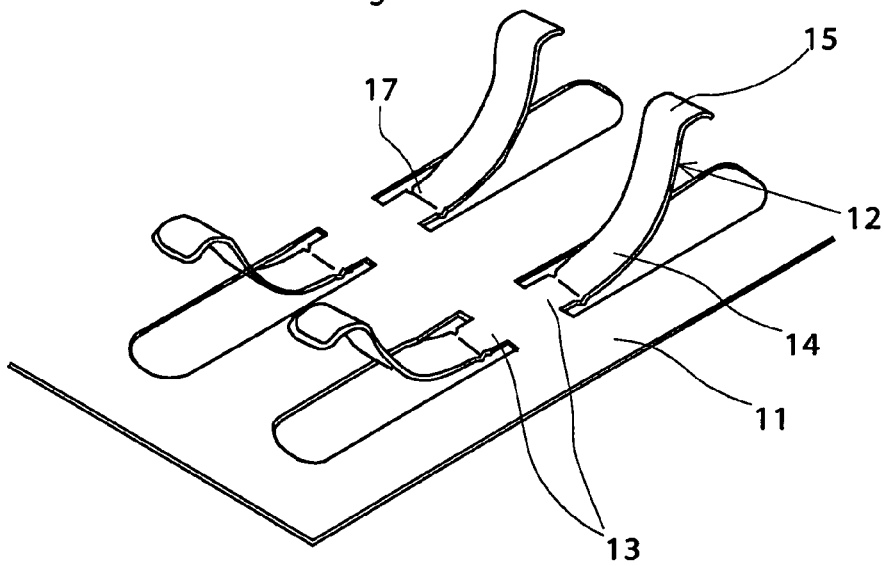
FIG. 4B is an enlarged schematic perspective view of leaf springs.
Figure 4C:
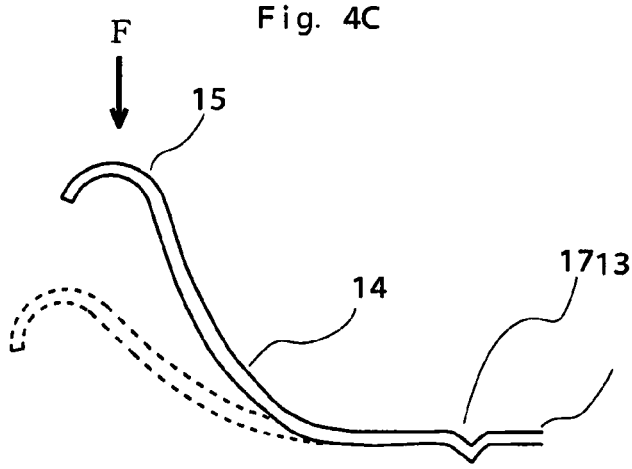
FIG. 4C is a schematic lateral view of one of the leaf springs, illustrating the operation of each of the leaf springs of FIG. 4A.

FIG. 4A is a schematic perspective view of still another embodiment of leaf springs according to the present invention. FIG. 4B is an enlarged schematic perspective view of leaf springs. FIG. 4C is a schematic lateral view of one of the leaf springs, illustrating the operation of each of the leaf springs of FIG. 4A.

Each leaf spring 12 is prepared by partly cutting a plate member except the connecting section 13 of the leaf spring holding member 11 and the leaf spring 12. It rises up toward the electrode it electro-conductively touches from the surface of the leaf spring holding member at a position separated from the connecting section 13 on the plane of the leaf spring holding member to draw a curve. The leaf spring 12 has an electrode touching section 15 at the front end thereof.

As the electrode touching section 15 of each leaf spring 12 is subjected to force F, the leaf spring 12 is deformed at the crooked section 14 that is separated from the connecting section 13 as indicated by broken lines in FIG. 4C. Then, as a result, it is possible to avoid concentration of stress at the connecting section that can arise when a leaf spring is made to rise and extend obliquely immediately from a connecting section.

It is possible to further reduce the stress applied to the connecting section 13 by forming a recessed section 17 in parallel with the connecting section 13 between the connecting section 13 and the crooked section 14 of the leaf spring 12.

The recessed section 17 can be formed by way of a bending process in the course of preparing the leaf spring.

Figure 5A:
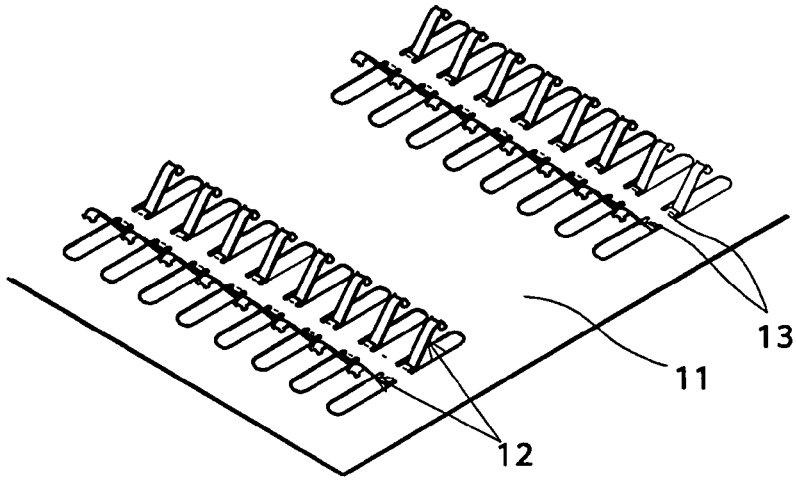
FIG. 5A is a schematic perspective view of still another embodiment of leaf springs according to the present invention.
Figure 5B:
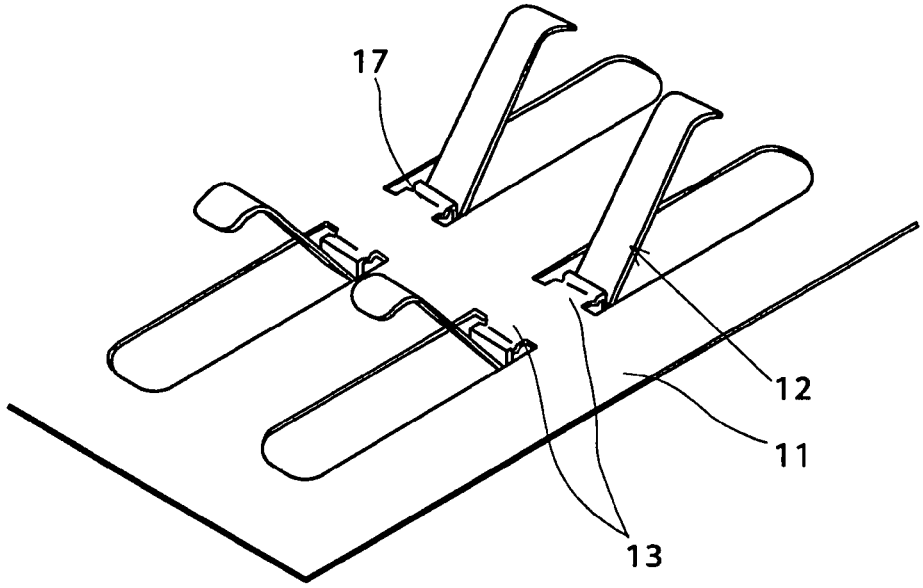
FIG. 5B is an enlarged schematic perspective view of leaf springs.
Figure 5C:
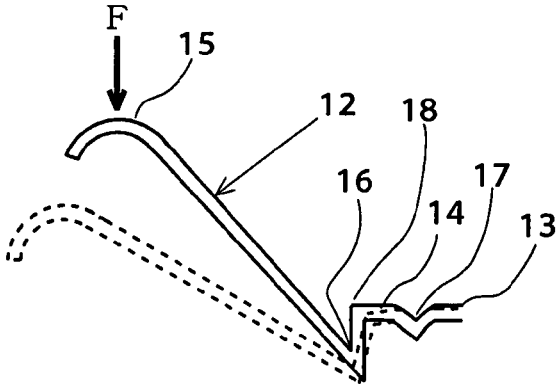
FIG. 5C is a schematic lateral view of one of the leaf springs, illustrating the operation of each of the leaf springs of FIG. 5A.

FIG. 5A is a schematic perspective view of still another embodiment of leaf springs according to the present invention. FIG. 5B is an enlarged schematic perspective view of leaf springs. FIG. 5C is a schematic lateral view of one of the leaf springs, illustrating the operation of each of the leaf springs of FIG. 5A Each leaf spring 12 is prepared by partly cutting a plate member except the connecting section 13 of the leaf spring holding member 11 and the leaf spring 12. The leaf spring extends from the connecting section 13 on the plane of the leaf spring holding member and is bent orthogonally toward the electrode chamber bulkhead side from a down-falling section 18. Then, it is extended to rise upward obliquely toward the electrode it electro-conductively touches from an up-rising section 16. The leaf spring 12 has an electrode touching section 15 at the front end thereof.

The distance between the down-falling section 18 and the up-rising section 16 may be selected appropriately according to the characteristics of the member and other factors.

As the electrode touching section 15 of each leaf spring 12 is subjected to force F, the leaf spring 12 is deformed at the crooked section 14 that is separated from the connecting section 13 as indicated by broken lines in FIG. 5C. Then, as a result, it is possible to avoid concentration of stress at the connecting section that can arise when a leaf spring is made to rise and extend obliquely immediately from a connecting section.

It is possible to further reduce the stress applied to the connecting section 13 by forming a recessed section 17 in parallel with the connecting section 13 between the connecting section 13 and the crooked section 14 of the leaf spring 12.

The recessed section 17 can be formed by way of a bending process in the course of preparing the leaf spring.

Figure 6A:
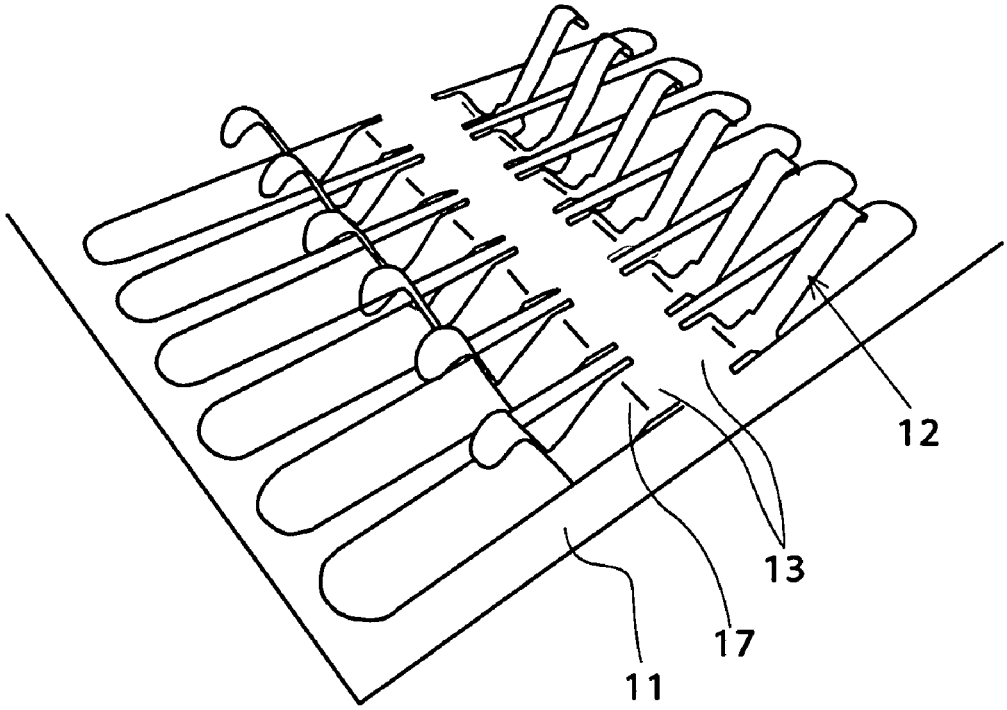
FIG. 6A is a schematic perspective view of still another embodiment of leaf springs according to the present invention.
Figure 6B:
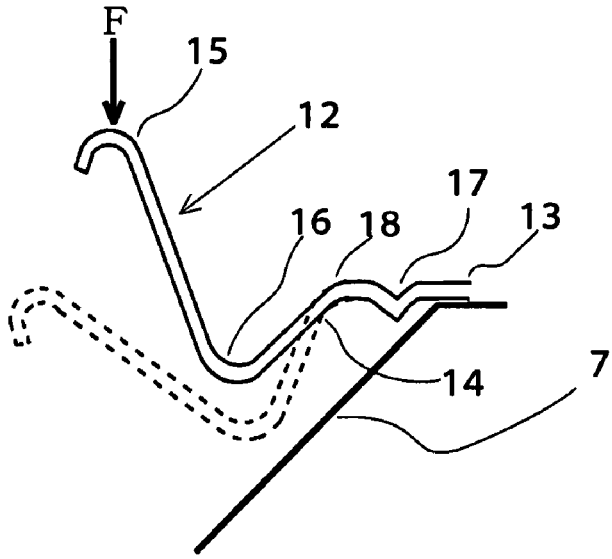
FIG. 6B is a schematic lateral view of one of the leaf springs, illustrating the operation of each of the leaf spring of FIG. 6A.

FIG. 6A is a schematic perspective view of still another embodiment of leaf springs according to the present invention. FIG. 6B is a schematic lateral view of one of the leaf springs, illustrating the operation of each of the leaf spring of FIG. 6A.

The leaf springs 12 are prepared integrally with the leaf spring holding member 11 by partly cutting a plate member except the connecting sections 13 thereof. Each leaf spring 12 extends from the connecting section 13 on the plane of the leaf spring holding member and is bent obliquely toward the electrode chamber bulkhead side from a down-falling section 18. Then, it is extended to rise upward obliquely toward the electrode it electro-conductively touches from an up-rising section 16. The leaf spring 12 has an electrode touching section 15 at the front end thereof.

The distance between the down-falling section 18 and the up-rising section 16 may be selected appropriately depending on the characteristics of the member and other factors.

As the electrode touching section 15 of each leaf spring 12 is subjected to force F, the leaf spring 12 is deformed at the crooked section 14 that is separated from the connecting section 13 and the up-rising section 16 as indicated by broken lines in FIG. 6B. Then, as a result, it is possible to avoid concentration of stress at the connecting section that can arise when a leaf spring is made to rise and extend obliquely immediately from a connecting section.

Since the leaf springs extend obliquely downward form the down-falling section 16, they do not collide with the cathode chamber bulkhead 7 if they are pressed in an electrolyzer where the space separating the cathode chamber bulkhead 7 and the leaf spring holding member 11 is small. In other words, the leaf springs operate very smoothly.

It is possible to further reduce the stress applied to the connecting section 13 by forming a recessed section 17 in parallel with the connecting section 13 between the connecting section 13 and the crooked section 14 of each leaf spring 12.

The recessed section 17 can be formed by way of a bending process in the course of preparing the leaf spring.

Figure 7A:
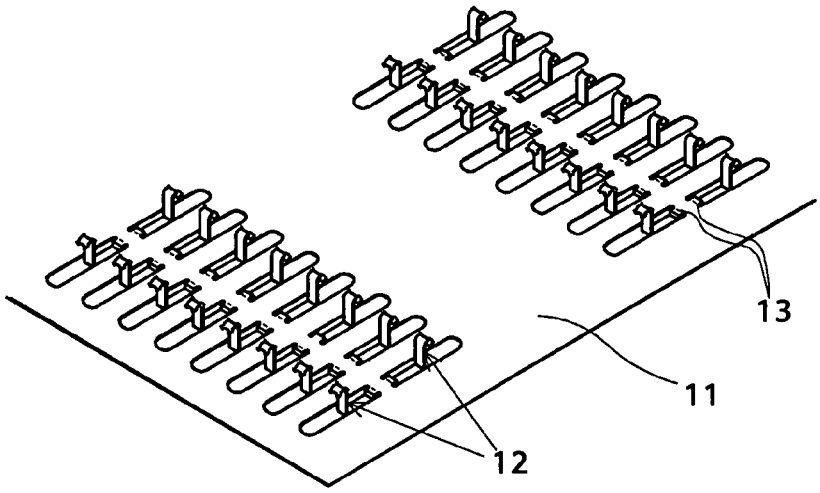
FIG. 7A is a schematic perspective view of still another embodiment of leaf springs according to the present invention.
Figure 7B:
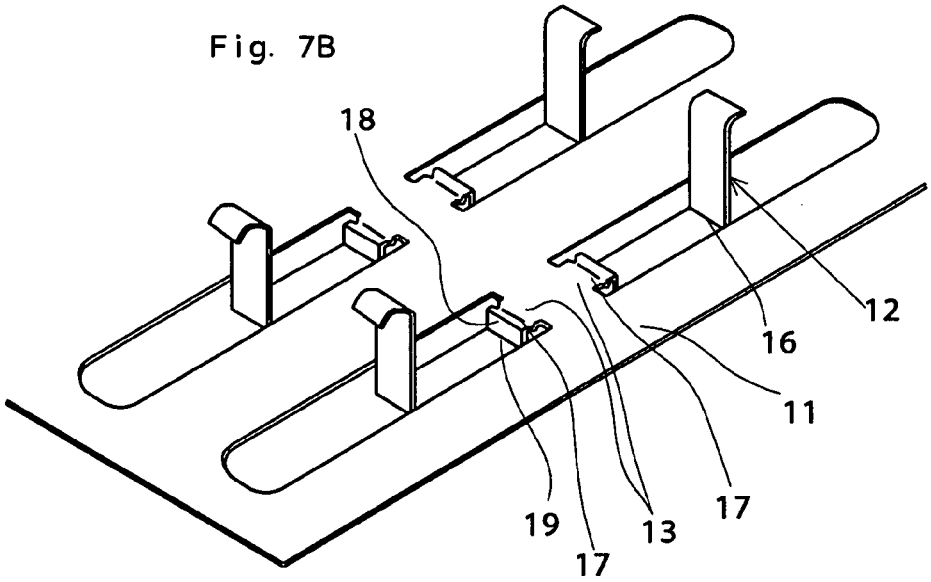
FIG. 7B is an enlarged schematic perspective view of leaf springs.
Figure 7C:
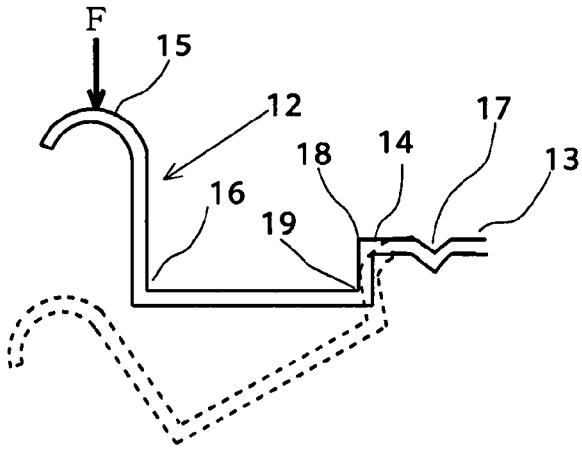
FIG. 7C is a schematic lateral view of one of the leaf springs, illustrating the operation of each of the leaf springs of FIG. 7A.

FIG. 7A is a schematic perspective view of still another embodiment of leaf springs according to the present invention. FIG. 7B is an enlarged schematic perspective view of leaf springs. FIG. 7C is a schematic lateral view of one of the leaf springs, illustrating the operation of each of the leaf springs of FIG. 7A.

The leaf springs 12 are prepared integrally with the leaf spring holding member 11 by partly cutting a plate member except the connecting sections 13 thereof. Each leaf spring 12 extends from the connecting section 13 on the plane of the leaf spring holding member and is bent orthogonally toward the electrode chamber bulkhead side from a down-falling section 18. Then, it is extended to horizontally from a horizontally bent section 19 and then vertically toward the electrode it electro-conductively touches from an up-rising section 16. The leaf spring 12 has an electrode touching section 15 at the front end thereof.

The distance between the connecting section 13 and the down-falling section 18, the distance between the down-falling section 18 and the horizontally bent section 19 and the distance between the horizontally bent section 19 and the up-rising section 16 may be selected appropriately depending on the characteristics of the member and other factors. However, in order for the leaf springs to operate smoothly, the distance between the down-falling section 18 and the horizontally bent section 19 is preferably made smaller than the other distances.

As the electrode touching section 15 of each leaf spring 12 is subjected to force F, the leaf spring 12 is deformed at bent section 14 that is separated from the connecting section 13, the down-falling section 18, the horizontally bent section 19 and the up-rising section 16 as indicated by broken lines in FIG. 7C. Then, as a result, it is possible to avoid concentration of stress at the connecting section that can arise when a leaf spring is made to rise and extend obliquely immediately from a connecting section.

It is possible to further reduce the stress applied to the connecting section 13 by forming a recessed section 17 in parallel with the connecting section 13 between the connecting section 13 and the crooked section 14 of each leaf spring 12.

The recessed section 17 can be formed by way of a bending process in the course of preparing the leaf spring.

Figure 8A:
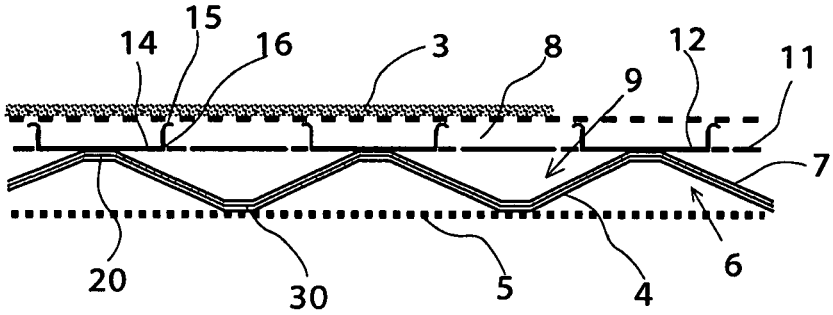
FIG. 8A is a partial schematic cross sectional view of another embodiment of ion exchange membrane electrolyzer according to the present invention taken in a horizontal direction of the electrolyzer, which is a view that corresponds to FIG. 1C.
Figure 8B:
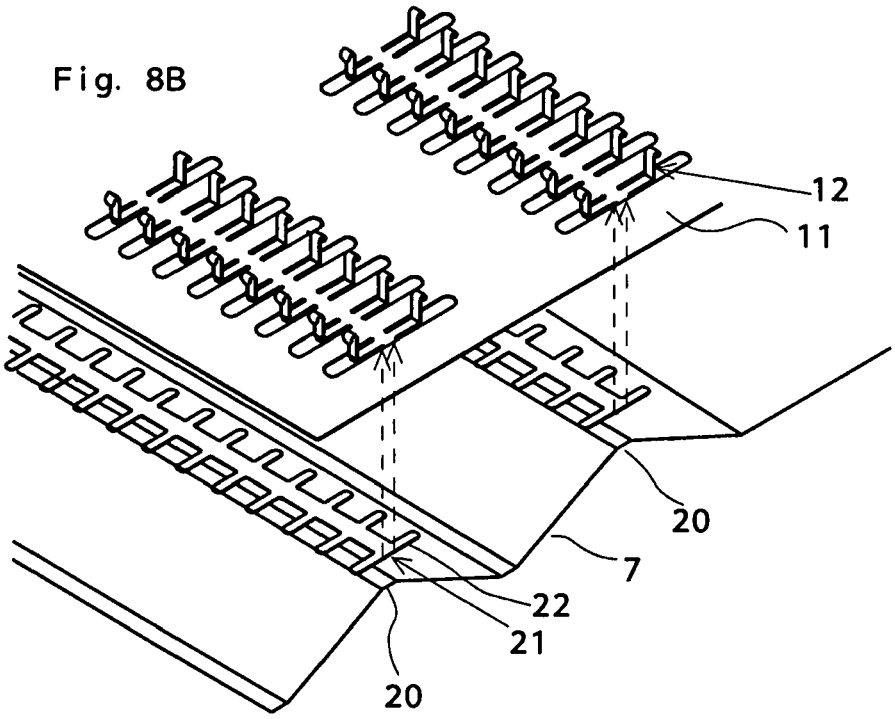
FIG. 8B is an exploded schematic perspective view of the embodiment of FIG. 8A, illustrating the connecting section of the leaf spring holding member and the cathode chamber bulkhead.
Figure 8C:
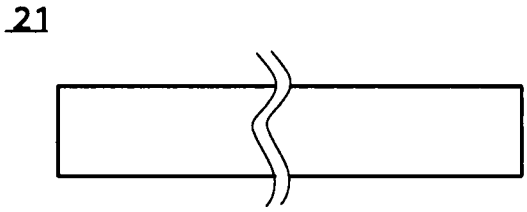
FIGS. 8C and 8D are schematic illustrations of assisting members that can be arranged at the connecting section.
Figure 8D:
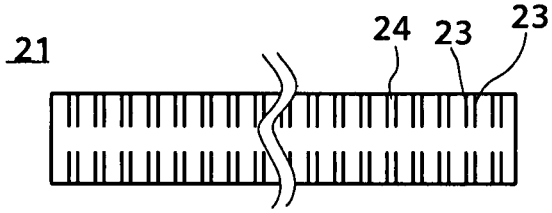

FIG. 8A is a partial schematic cross sectional view of another embodiment of ion exchange membrane electrolyzer according to the present invention taken in a horizontal direction of the electrolyzer, which is a view that corresponds to FIG. 1C. FIG. 8B is an exploded schematic perspective view of the embodiment of FIG. 8A, illustrating the connecting section of the leaf spring holding member and the cathode chamber bulkhead. FIGS. 8C and 8D are schematic illustrations of assisting members that can be arranged at the connecting section.

The leaf spring holding member 11 is directly connected to the connecting section 20 arranged at the cathode chamber bulkhead 7 in the ion exchange membrane electrolyzer illustrated in FIG. 1, whereas an assisting member 21 is arranged in the ion exchange membrane electrolyzer of FIG. 8A at the cathode chamber bulkhead connecting section 20 formed at each apex of the cathode chamber bulkhead 7 and the cathode chamber bulkhead 7, the assisting members 21 and the leaf spring holding member 11 are integrally connected as shown in FIG. 8B.

If the height by which the leaf springs are compressed, or the depth by which they are pressed down, is same, the leaf springs cannot be easily plastically deformed when the their thickness is reduced. However, as a result of arranging such assisting members, the pressure of the touching area of the cathode and the electrode touching sections at the front ends of the leaf springs is reduced to prevent the electric resistance from rising.

Each assisting member 21 shown in FIG. 8B is a comb-shaped member having teeth sections 22 extending to the opposite lateral sides from a central section. Preferably, the teeth sections 22 have a length substrate equal to the length of the projection of the leaf springs on the leaf spring holding member side.

When pressure is applied to the electrode touching sections 15 at the front ends of the leaf springs 12, the leaf springs are supported by the teeth sections 22 extending to the opposite lateral sides from the central sections of the assisting members 21 so that the reaction force of the leaf springs due to the pressure applied to the electrode touching sections is increased if compared with an arrangement where no such assisting members are provided. Then, the contact electric resistance of the electrode touching sections at the front ends of the leaf springs can be reduced if a thin material that can be easily plastically deformed is used for the leaf springs because of the increased reaction force.

Plate-shaped members like the one shown in FIG. 8C or FIG. 8D may be used for the assisting members 21 with cut lines 23 formed at the opposite lateral sides to produce deformed sections 24 when pressed.

While an ion exchange membrane electrolyzer according to the present invention is described above in terms of filter press type bipolar ion exchange membrane electrolyzer, the present invention is equally applicable to a filter press type mono-polar ion exchange membrane electrolyzer.

Figure 9A:
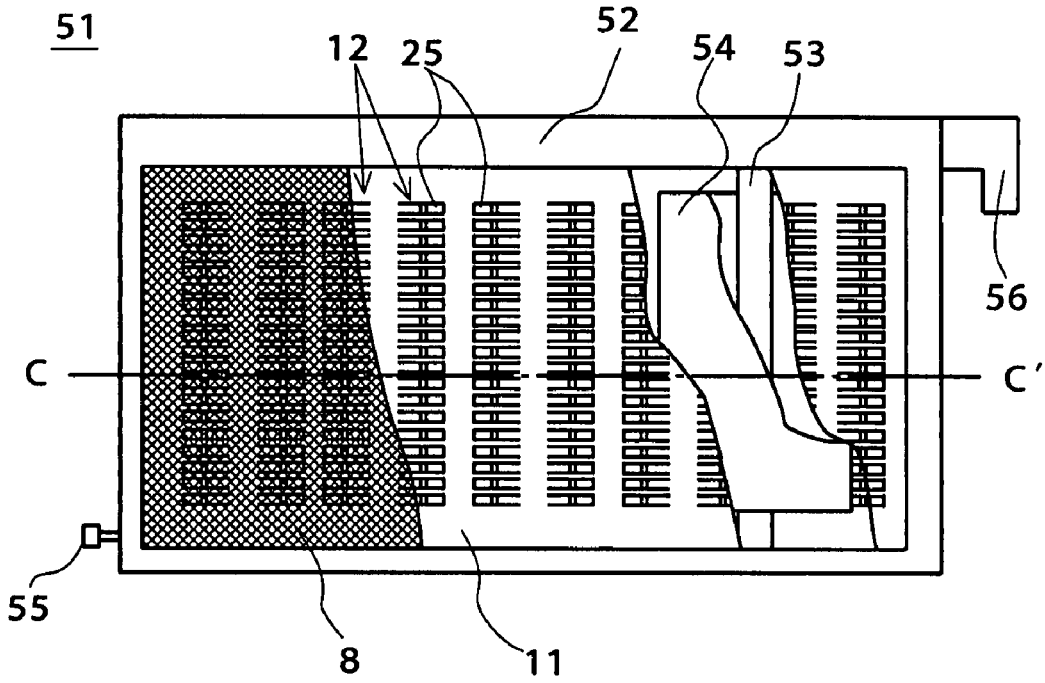
FIG. 9A is a schematic partially cut out plan view of a filter press type mono-polar unit electrolyzer provided with leaf springs.

FIG. 9A is a schematic partially cut out plan view of a filter press type mono-polar unit electrolyzer provided with leaf springs according to the present invention, which are arranged at the cathode chamber side.

Figure 9B:
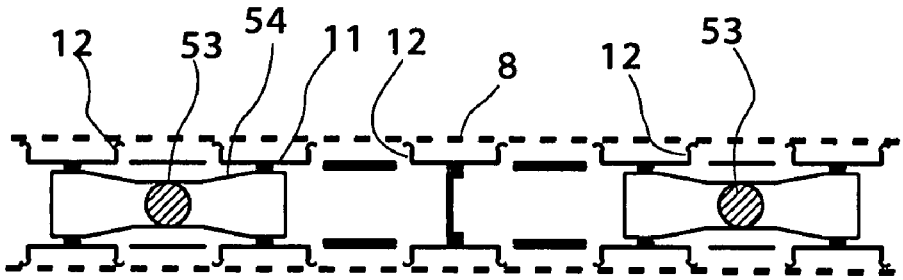
FIG. 9B is a schematic cross sectional view of the electrolyzer of FIG. 9A taken along line C-C' in FIG. 9A.

FIG. 9B is a schematic cross sectional view of the electrolyzer of FIG. 9A taken along line C-C' in FIG. 9A.

Electric conductors 53 are mounted to the electrolyzer frame 52 of each mono-polar type unit electrolyzer 51. Each electric conductor 53 forms a falling flow channel of electrolyte in the inside. More specifically each electric conductor 53 is provided with an electric current conducting means 54 that forms a falling flow channel of electrolyte in the inside.

Leaf spring holding members 11 are connected to opposite surfaces of each electric current conducting means 54 and leaf springs 12 are connected to the connecting section 13 of each leaf spring holding member 11. The electrode touching sections 15 formed at the front ends of the leaf springs 12 contact the cathode 8 to establish an electrically conductive connection and make the inter-electrode gap adjustable in a direction orthogonal relative to the electrode surfaces.

Each leaf spring holding member 11 has openings 25 produced when cutting a material plate member and subjecting the cut sections to a bending process at the time of preparing the leaf springs 12 so that the bubble-containing catholyte that comes up along the electrode surface rises on the back surfaces of the leaf spring holding members through the openings 25 thereof and, after releasing gas at an upper part of the electrode chamber, falls through the cylindrical section in each electric current conducting means 54 before it is electrolyzed in the electrolyzer with the catholyte supplied by way of the catholyte supply port 55 and discharged from the catholyte discharge port 56.

FIGS. 10A through 10D are schematic plan views of leaf springs that are cut out but not bent yet, showing the profiles thereof. Each of FIGS. 10A through 10D shows adjacently located two leaf springs that are cut out but not subjected to a shaping process yet.

Figure 10A:
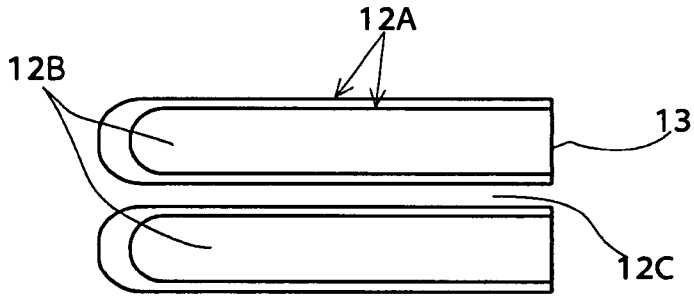
FIGS. 10A through 10D are schematic plan views of leaf springs that are cut out but not bent yet, showing the profiles thereof.

FIG. 10A shows leaf springs produced by cutting a leaf spring holding member along predetermined cutting lines 12A, leaving the connecting sections 13 uncut. The produced leaf spring forming members 12B have a width equal to the width of the connecting sections 13.

The leaf springs 12 are separated from each other by a remaining part 12C so that, when the electrode is pressed toward the leaf spring holding member side by excessive counter pressure, the electrode touches the leaf spring holding member and is held by the latter. Then, the leaf springs are prevented from being deformed further. As a result, it is possible to prevent the electrode, the ion exchange membrane and the leaf springs from being damaged if excessive counter pressure arises. The gap separating adjacent leaf springs can be selected appropriately according to the thickness of the base member metal, the rigidity thereof and other factors.

Figure 10B:
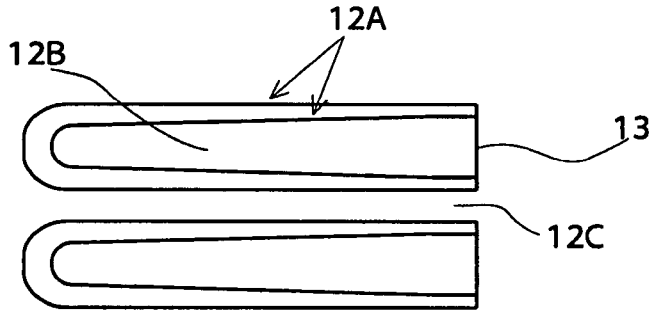

In FIG. 10B, the leaf spring forming members 12B produced by cutting a leaf spring holding member along predetermined cutting lines 12A show a tapered profile and have a width that diminishes from the connecting section 13 toward the front end. When the final leaf springs are prepared by bending the forming members 12B at predetermined positions, the stress applied to the connecting sections 13 can be reduced because the front ends are small.

Figure 10C:
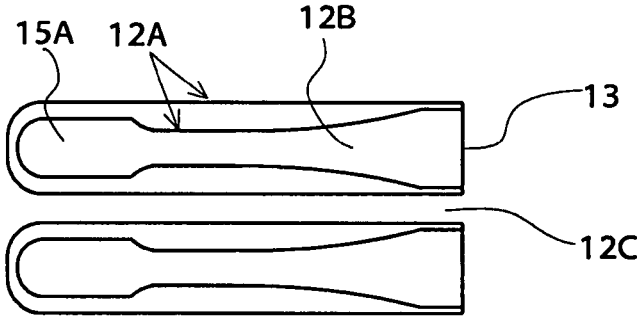

In FIG. 10C, the leaf spring forming members 12B produced by cutting a leaf spring holding member along predetermined cutting lines 12A show a tapered profile and have a width that diminishes from the connecting section 13 toward the front end. The electrode touching section forming members 15A arranged at the front ends of the leaf springs are made to show a large width.

Figure 10D:
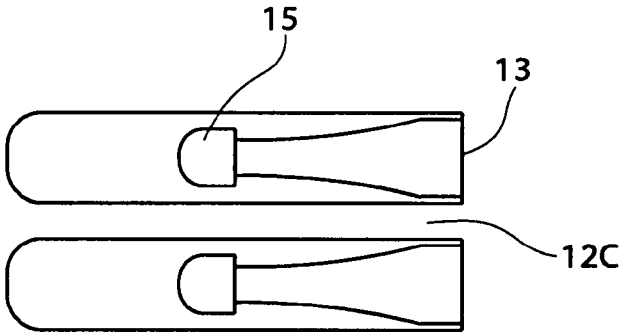
Figure 11A:
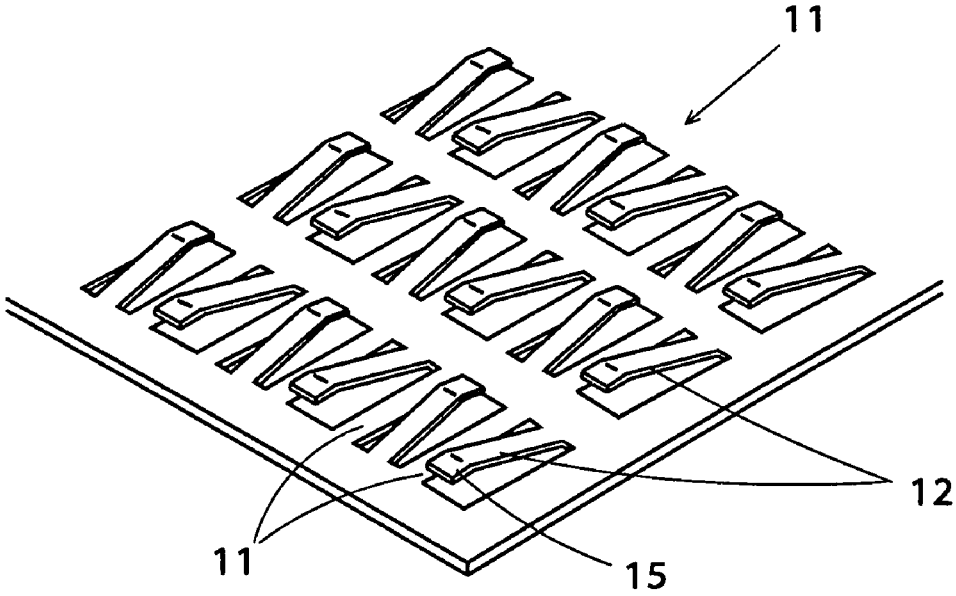
FIGS. 11A and 11B are schematic illustrations of a known electrolyzer provided with leaf springs.
Figure 11B:
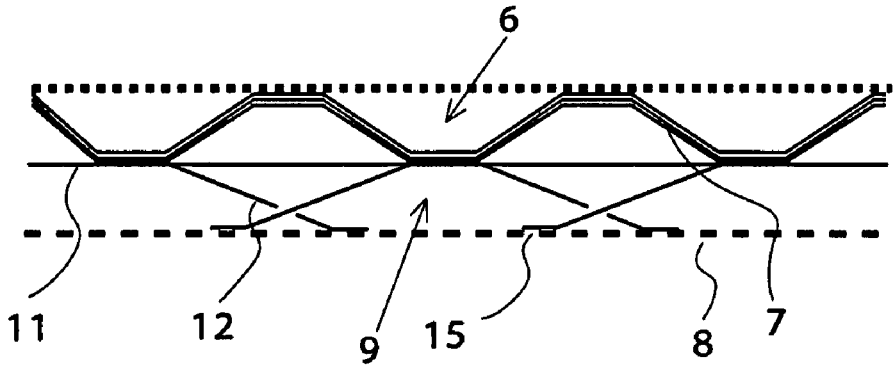

FIG. 10D shows the leaf spring forming members 12B of FIG. 10C after being subjected to a predetermined bending process. Electrode touching sections 15 having a large area are formed at the front ends thereof so that it is possible to reduce the contact pressure of the electrode touching sections and also the contact electric resistance between the electrode touching sections and the electrode.

While the leaf springs and the leaf spring holding member are arranged at the cathode side in the above description, they may be arranged not at the cathode side but at the anode side.

When they are arranged at the cathode side, materials that can be used for the leaf spring holding member include nickel, nickel alloys and stainless steel that are satisfactorily anti-corrosive in the environment in the inside of the cathode chamber. The cathode can be formed by using nickel, a porous body or a network of nickel alloy or expanded metal or by arranging a coat layer of an electrode catalyst substance such as a layer containing a platinum group metal, a layer containing Raney nickel or an active-carbon-containing nickel layer on the surface of a base member of any of the above listed materials to reduce the hydrogen over-voltage.

When, on the other hand, they are arranged at the anode side, materials that can be used for the leaf spring holding member include thin film forming metals such as titanium, tantalum and zirconium as well as alloys thereof. The anode can be formed by using a thin film forming metal such as titanium, tantalum or zirconium or by arranging a coat layer of an electrode catalyst substance such as a layer containing a platinum group metal or a layer containing oxide of a platinum group metal on the surface of a base member of any of the above listed materials.

While the dimensions of each leaf spring is defined as a function of the electrode area and other factors of the electrolyzer, each leaf spring may preferably have a thickness between 0.1 mm and 0.3 mm, a width between 2 mm and 10 mm and a length between 15 mm and 50 mm.

An ion exchange membrane electrolyzer according to the present invention comprises leaf springs that contact an electrode at the electrode touching sections thereof to establish an electrically conductive connection and each of the leaf springs has a crooked section arranged at a position separated from the connecting section thereof connecting itself to the leaf spring holding member that is adapted to be deformed when the electrode surface is pressed. Therefore, when the leaf springs are pressed, stress of deformation is not concentrated to the connecting sections of the leaf springs.

Thus, the present invention provides an ion exchange membrane electrolyzer in which the leaf springs are not plastically deformed and do not lose the characteristics as springs if they are subjected to abnormally high pressure applied to them at the start of an operation of the electrolyzer.

What is claimed is:

1. An ion exchange membrane electrolyzer, comprising:

electrodes at least either of which is held in contact with leaf springs formed integrally with a leaf spring holding member arranged in an electrode chamber so as to extend toward the electrode and remain electrically energized at the respective electrode touching sections thereof, each of the leaf springs having a crooked section arranged at a position separated from its connecting section connecting itself to the leaf spring holding member and adapted to be bent toward the leaf spring holding member when the electrode touching section is pressed toward the leaf spring holding member side, wherein each of the leaf springs has a recessed section formed between the connecting section and the crooked section to move away from the electrode that is held in contact with the leaf spring so as to extend in parallel with the connecting section.

2. The ion exchange membrane electrolyzer according to claim 1, wherein each of the leaf springs has a touching section bent toward the leaf spring holding member at the front end thereof so that the touching section of the leaf spring and the electrode are held in contact over a flat surface or a curved surface of the touching section.

3. The ion exchange membrane electrolyzer according to claim 2, wherein the width of each of the leaf springs is gradually diminished toward the front end and may or may not be increased once again at the touching section.

4. The ion exchange membrane electrolyzer according to claim 1, wherein a leaf spring holding member has an opening at the projection surface of each of the leaf springs and the projection surfaces of adjacent leaf springs are connected by the leaf spring holding member.

5. The ion exchange membrane electrolyzer according to claim 1, wherein the leaf spring holding member is connected to the electrode chamber bulkhead of a bipolar type electrolyzer to establish a fixed conductive connection.

6. The ion exchange membrane electrolyzer according to claim 1, wherein the leaf spring holding member forms a cylindrical internal falling flow channel of electrolyte of a window-frame-shaped mono-polar type electrolyzer and is connected to a current distribution means for distributing an electric current to establish a fixed conductive connection.

7. An ion exchange membrane electrolyzer comprising:

electrodes at least either of which is held in contact with leaf springs formed integrally with a leaf spring holding member arranged in an electrode chamber so as to extend toward the electrode and remain electrically energized at the respective electrode touching sections thereof, each of the leaf springs having a crooked section arranged at a position separated from its connecting section connecting itself to the leaf spring holding member and adapted to be bent toward the leaf spring holding member when the electrode touching section is pressed toward the leaf spring holding member side, and wherein each of the leaf springs has a down-falling section formed at a position separated from the connecting section connecting itself to the leaf spring holding member so as to fall down and move away from the electrode that is held in contact with the leaf spring and an up-rising section formed at a position closer to the front end so as to rise up again toward the electrode.

8. An ion exchange membrane electrolyzer comprising:

electrodes at least either of which is held in contact with leaf springs formed integrally with a leaf spring holding member arranged in an electrode chamber so as to extend toward the electrode and remain electrically energized at the respective electrode touching sections thereof, each of the leaf springs having a crooked section arranged at a position separated from its connecting section connecting itself to the leaf spring holding member and adapted to be bent toward the leaf spring holding member when the electrode touching section is pressed toward the leaf spring holding member side, wherein the leaf spring holding member is connected to the electrode chamber bulkhead of a bipolar type electrolyzer to establish a fixed conductive connection, and a connection assisting member that is a plate-shaped member or a comb-shaped member having a teeth section extending in the area where the leaf springs are projected to the side opposite to the electrode held in contact with the leaf springs arranged between and connected to the leaf spring holding member and the electrode chamber bulkhead surface or the current distribution means.

* * * * *